US011017960B2

(12) United States Patent
Zhang et al.

(10) Patent No.: US 11,017,960 B2
(45) Date of Patent: May 25, 2021

(54) ELECTRICAL CONTACT SYSTEM

(71) Applicant: Tyco Electronics (Shenzhen) Co., Shenzhen (CN)

(72) Inventors: Xiaoning Zhang, Shenzhen (CN); Teng Zou, Shenzhen (CN)

(73) Assignee: Tyco Electronics (Shenzhen) Co. Ltd, Shenzhen (CN)

( * ) Notice: Subject to any disclaimer, the term of this patent is extended or adjusted under 35 U.S.C. 154(b) by 0 days.

(21) Appl. No.: 16/698,543

(22) Filed: Nov. 27, 2019

(65) Prior Publication Data

US 2020/0098528 A1 Mar. 26, 2020

Related U.S. Application Data

(63) Continuation of application No. PCT/EP2018/064357, filed on May 31, 2018.

(30) Foreign Application Priority Data

Jun. 1, 2017 (CN) ..... 201710403385.X

(51) Int. Cl.
*H01H 1/18* (2006.01)
*H01H 1/20* (2006.01)
*H01H 1/22* (2006.01)

(52) U.S. Cl.
CPC ..... *H01H 1/205* (2013.01); *H01H 1/18* (2013.01); *H01H 1/221* (2013.01); *H01H 2001/223* (2013.01)

(58) Field of Classification Search
CPC ..... H01H 1/205; H01H 1/18; H01H 1/221; H01H 2001/223; H01H 1/22; H01H 1/58;
(Continued)

(56) References Cited

U.S. PATENT DOCUMENTS 5,909,020 A * 6/1999 Galione ..... H01H 23/20 200/438
2006/0119455 A1 6/2006 Park
2008/0218297 A1* 9/2008 Kim ..... H01H 71/08 335/202

FOREIGN PATENT DOCUMENTS

EP 0309923 A2 4/1989
EP 1109189 A2 6/2001
EP 2472537 A1 7/2012

OTHER PUBLICATIONS

Notification, and the International Search Report and the Written Opinion of the International Searching Authority, PCT/EP2018/064357, dated Sep. 11, 2018, 12 pages.

* cited by examiner

*Primary Examiner* — Ahmed M Saeed
(74) *Attorney, Agent, or Firm* — Barley Snyder

(57) ABSTRACT

An electrical contact system includes a pair of static contacts, a rotatable member disposed between the static contacts and rotatable about a rotation axis between a first position and a second position, and a movable contact mounted on and rotated with the rotatable member. A pair of opposite ends of the movable contact are in electrical contact with the static contacts when the rotatable member is rotated to the first position. The ends of the movable contact are separated from the static contacts when the rotatable member is rotated to the second position. The movable contact has a Z-shape and is slidably mounted on the rotatable member. The movable contact slides under a pushing force from a first static contact of the static contacts toward a second static contact of the static contacts to be in electrical contact with the second static contact.

16 Claims, 4 Drawing Sheets

(58) Field of Classification Search
CPC ..... H01H 1/32; H01H 1/2041; H01H 1/2083; H01H 3/32; H01H 2225/018; H01H 2225/01; H01H 13/44
See application file for complete search history.

ELECTRICAL CONTACT SYSTEM

CROSS-REFERENCE TO RELATED APPLICATIONS

This application is a continuation of PCT International Application No. PCT/EP2018/064357, filed on May 31, 2018, which claims priority under 35 U.S.C. § 119 to Chinese Patent Application No. 201710403385.X, filed on Jun. 1, 2017.

FIELD OF THE INVENTION

The present invention relates to an electrical contact system and, more particularly, to a double contact system.

BACKGROUND

An electrical circuit may be automatically or manually switched on and off according to external specified signals and requirements. An electrical contact system is generally used to carry out the switch on and off of the electrical circuit. The electrical contact system has two types: a single contact system and a double contact system. The single contact system generally comprises a single movable contact and a single static contact. When the single movable contact is in contact with the single static contact, the electrical circuit is switched on. The double contact system generally comprises a pair of movable contacts and a pair of static contacts. When the pair of movable contacts are in contact with the pair static contacts, respectively, the electrical circuit is switched on.

Compared with the single contact system, the double contact system greatly increases the distance between the movable and static contacts and has better arc extinguishing performance. However, for the double contact system, the pair of movable contacts and the pair of static contacts must reliably and electrically contact with each other. If one of the pair of movable contacts does not reliably and electrically contact one of the pair of static contacts, the electrical circuit will not be able to be switched on.

In order to realize reliable electrical contact between the pair of movable contacts and the pair of static contacts in the double contact system, in general, a complex mechanism and a large spring are required. However, this leads to a complicated structure of the double contact system and increased difficulty in assembling the double contact system, which increases the manufacturing cost of the double contact system.

SUMMARY

An electrical contact system includes a pair of static contacts, a rotatable member disposed between the static contacts and rotatable about a rotation axis between a first position and a second position, and a movable contact mounted on and rotated with the rotatable member. A pair of opposite ends of the movable contact are in electrical contact with the static contacts when the rotatable member is rotated to the first position. The ends of the movable contact are separated from the static contacts when the rotatable member is rotated to the second position. The movable contact has a Z-shape and is slidably mounted on the rotatable member. The movable contact slides under a pushing force from a first static contact of the static contacts toward a second static contact of the static contacts to be in electrical contact with the second static contact.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
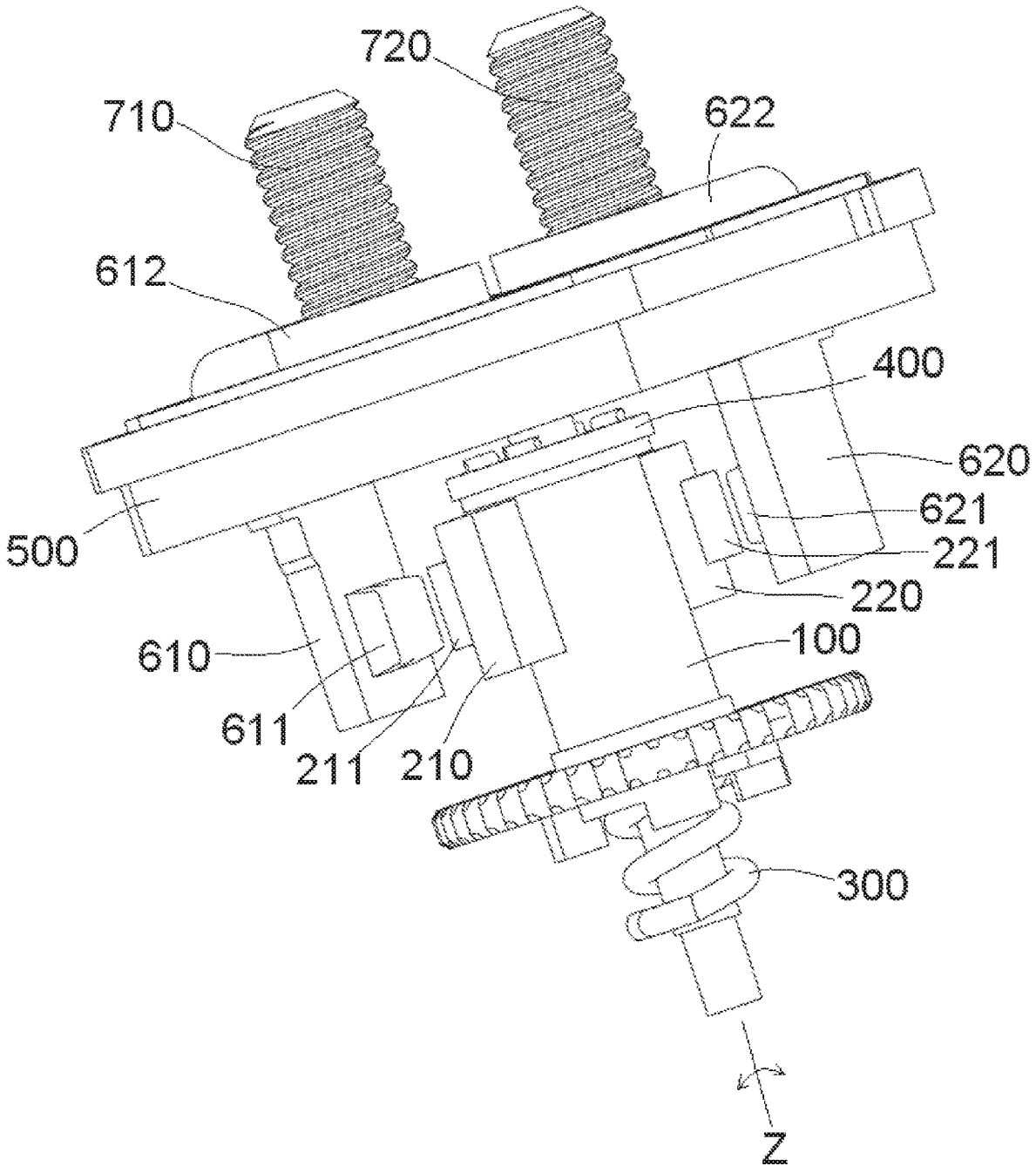
FIG. 1 is a perspective view of an electrical contact system according to an embodiment, in which a movable contact is separated from a pair of static contacts.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the invention to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
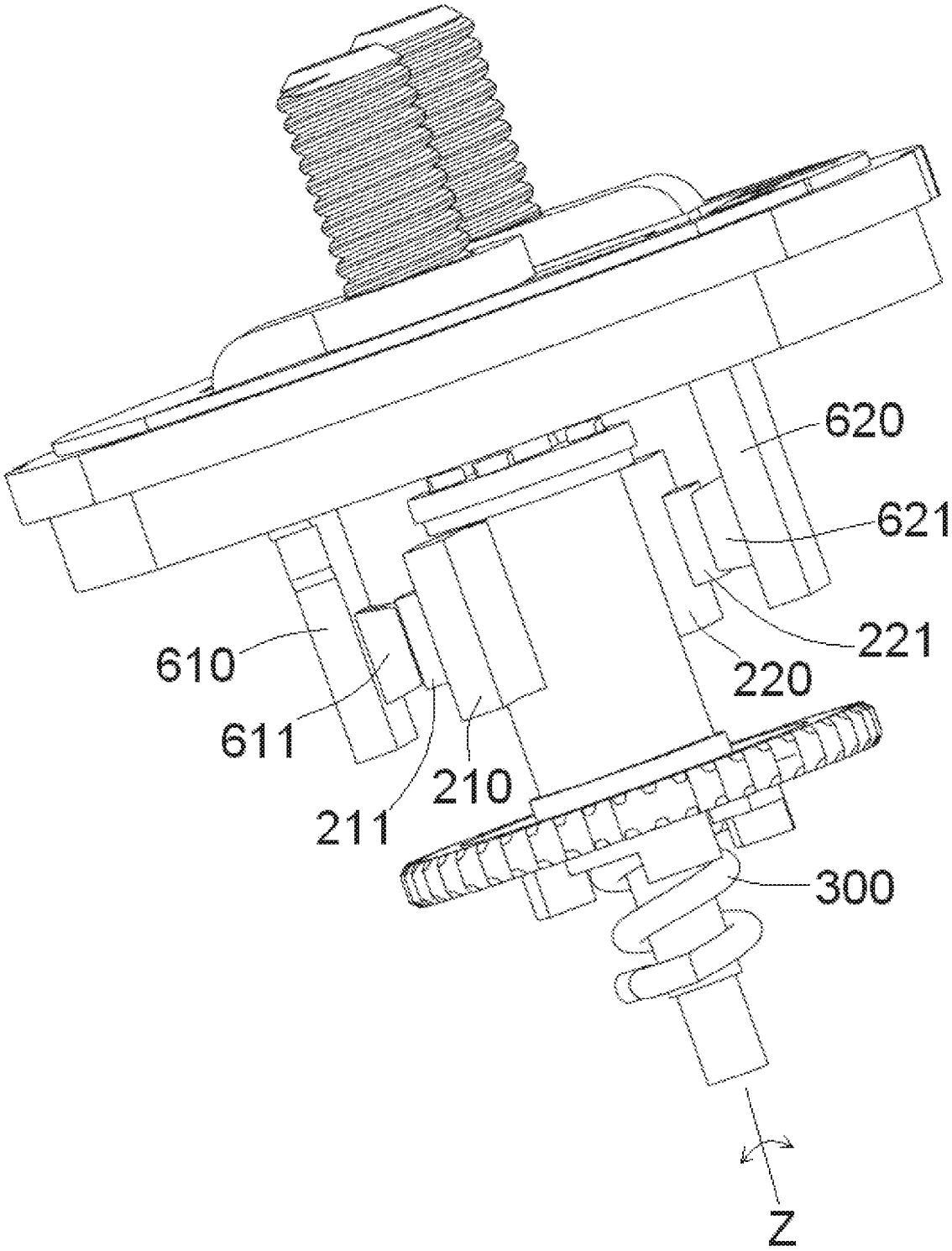
FIG. 2 is a perspective view of the electrical contact system, in which the movable contact is in electrical contact with the pair of static contacts.
Figure 3:
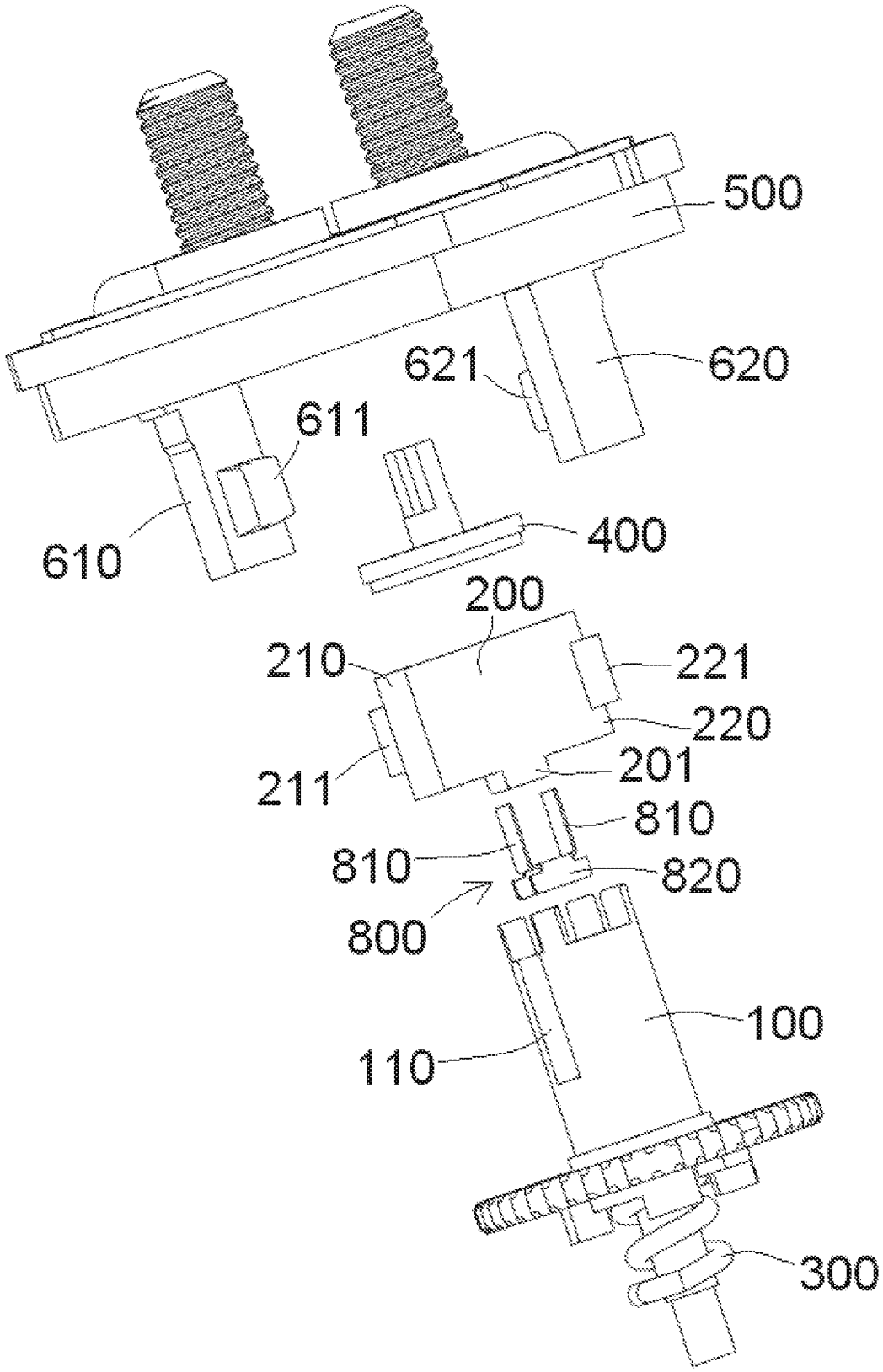
FIG. 3 is an exploded perspective view of the electrical contact system.

An electrical contact system according to an embodiment, as shown in FIGS. 1-3, comprises a pair of static contacts 610, 620, a rotatable member 100, and a movable contact 200. The rotatable member 100 is provided between the pair of static contacts 610, 620 and rotatable about a rotation axis Z between a first position and a second position. The movable contact 200 is mounted on the rotatable member 100 to be rotated with the rotatable member 100.

The movable contact 200 is shown separated from the static contacts 610, 620 in FIG. 1, and is shown electrically connected with the static contacts 610, 620 in FIG. 2. As shown in FIG. 2, when the rotatable member 100 is rotated to the first position, a pair of opposite ends 210, 220 of the movable contact 200 electrically contact the pair of static contacts 610, 620, respectively. In this way, an electrical circuit including the electrical contact system is switched on. As shown in FIG. 1, when the rotatable member 100 is rotated to the second position, the ends 210, 220 of the movable contact 200 are separated from the pair of static contacts 610, 620, respectively. In this way, the electrical circuit may be switched off.

Figure 4:
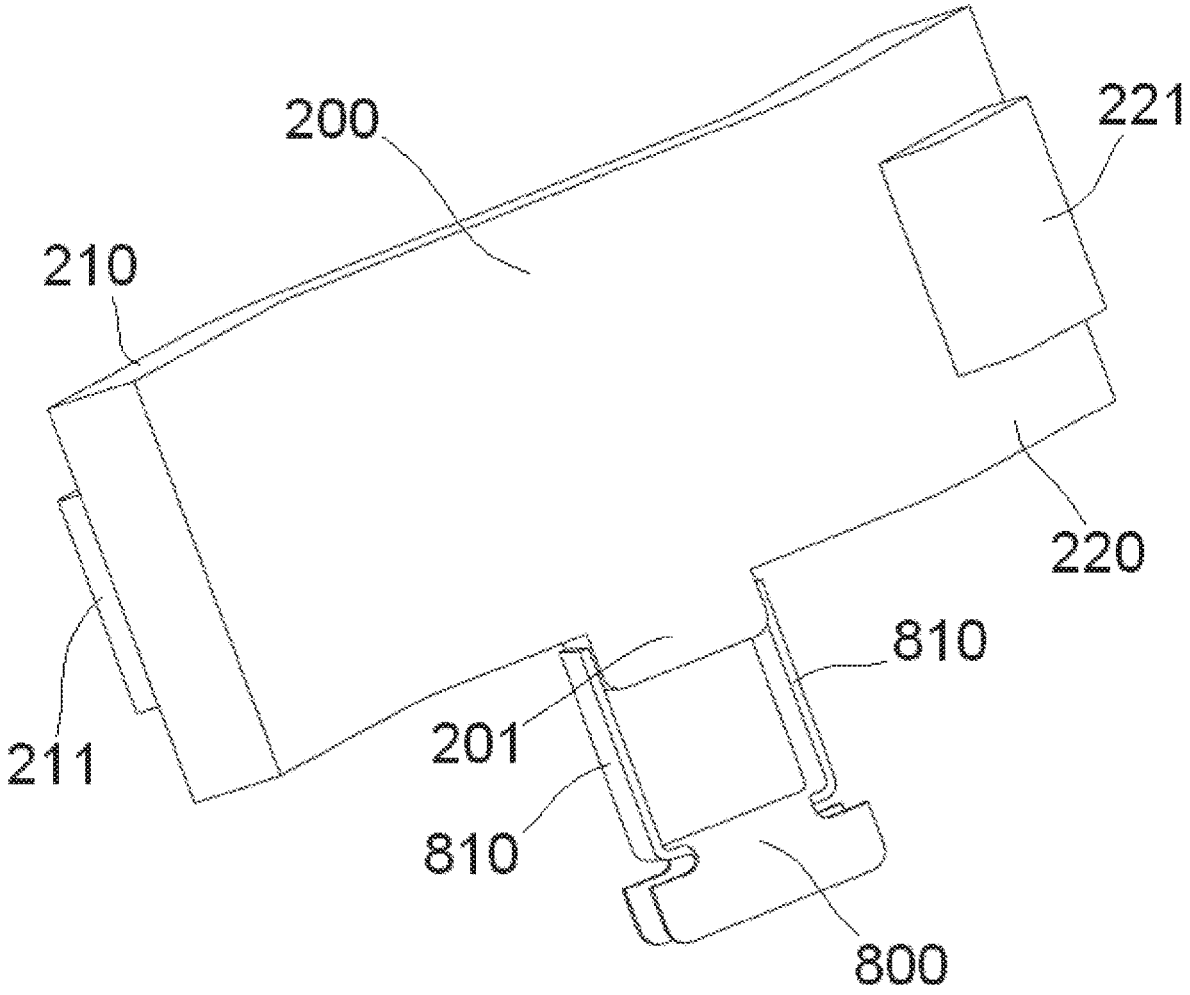
FIG. 4 is a perspective view of the movable contact and a leaf spring of the electrical contact system.

The movable contact 200, as shown in FIG. 4, has a Z-shape and is slidably mounted on the rotatable member 100, so as to allow the movable contact 200 to slide, under a pushing force from a first static contact 610 of the pair static contacts 610, 620, toward a second static contact 620 of the pair of static contacts 610, 620 and electrically contact the second static contacts 620.

As shown in FIGS. 1-3, a slot 110 is formed in the rotatable member 100. A main part of the movable contact 200 is received in the slot 110 and slidable in the slot 110 along a lateral direction perpendicular to the rotation axis Z.

As shown in FIGS. 1-4, a first convex contact point 211, 221 is formed on each end 210, 220 of the movable contact 200, and a second convex contact point 611, 621 is formed on each of the pair of static contacts 610, 620. The second convex contact points 611, 621 on the pair of static contacts 610, 620 electrically contact the first convex contact points 211, 221 on the ends 210, 220 of the movable contacts 200, respectively.

The electrical contact system, as shown in FIGS. 1-3, comprises a torsion spring 300 configured to apply a contact pressure between the first convex contact point 211, 212 and the second convex contact point 611, 621, so that the first convex contact points 211, 212 reliably and electrically contact the second convex contact points 611, 621.

The movable contact 200 is adapted to slide from an initial position to an offset position under the pushing force of the first static contact 610. After the ends 210, 220 of the movable contact 200 electrically contact the pair of static contacts 610, 620, the movable contact 200 is kept in the offset position. After the ends 210, 220 of the movable contact 200 are separated from the pair of static contacts 610, 620, the movable contact 200 is returned to the initial position.

The electrical contact system, as shown in FIG. 4, comprises a leaf spring 800 mounted on the rotatable member 100. The leaf spring 800 is configured to automatically reset the movable contact 200 to the initial position by its elastic reset force after the ends 210, 220 of the movable contact 200 are separated from the pair of static contacts 610, 620.

As shown in FIGS. 3 and 4, a protrusion 201 is formed on the movable contact 200, and the leaf spring 800 has a pair of elastic sheets 810 between which the protrusion 201 is clamped. Thereby, when the movable contact 200 is pushed to the offset position by the first static contact 610, the leaf spring 800 will be elastically deformed under the pushing of the movable contact 200. After the movable contact 200 is separated from the pair of static contacts 610, 620, the leaf spring 800 will automatically reset the movable contact 200 to the initial position by its elastic reset force. The leaf spring 800 has a fixation portion 820 adapted to be fixed to the rotatable member 100.

The electrical contact system, as shown in FIGS. 1-3, comprises a cap 400. The cap 400 is locked to a first end of the rotatable member 100, so as to prevent the movable contact 200 from sliding out of the slot 110 in an axial direction parallel to the rotation axis Z. In an embodiment, the cap 400 may be locked to one end of the rotatable member 100 by an elastic latch formed thereon.

The electrical contact system, as shown in FIGS. 1-3, comprises an insulation cover 500. The pair of static contacts 610, 620 is fixed on the insulation cover 500.

The electrical contact system, as shown in FIG. 1, comprises a pair of screws 710, 720 electrically connected to a pair of bases 612, 622 of the pair of static contacts 610, 620, respectively. The pair of screws 710, 720 electrically connect the pair of static contacts 610, 620 to a pair of wires.

A process of operating the electrical contact system will now be described with reference to FIGS. 1-3.

When an electrical circuit having the electrical contact system needs to be switched on, the rotatable member 100 is rotated by an external driving force to rotate the movable contact 200 toward the pair of static contacts 610, 620. While the movable contact 200 is rotated toward the pair of static contacts 610, 620, one 211 of the first convex contact points 211, 221 on the movable contact 200 will contact the first static contact 610, and then the first static contact 610 will push the movable contact 200 to move toward the second static contact 620, so that the other 221 of the first convex contact points 211, 221 on the movable contact 200 is rapidly moved into electrical contact with the second static contact 620. In this way, two first convex contact points 211, 221 on the movable contact 200 reliably and electrically contact two second convex contact points 611, 621 on the pair of static contacts 610, 620.

When the electrical circuit needs to be switched off, the rotatable member 100 is driven to rotate by a reset spring to rotate the movable contact 200 to a distance from the pair of static contacts 610, 620, such that the movable contact 200 is rapidly separated from the static contacts 610, 620.

In the described embodiments, the Z-shaped movable contact 200 switches the electrical circuit. When one end 210 of the movable contact 200 firstly contacts the first static contact 610, a contact pressure generated between the one end 210 of the movable contact 200 and the first static contact 610 forces the movable contact 200 to slide toward the offset position in the slot 110, so that an opposite end 220 of the movable contact 200 also reliably and electrically contacts the second static contact 620.

The electrical contact system according to the described embodiments requires less driving energy and has low energy consumption. Moreover, the electrical contact system of the present overcomes a poor contact of an electrical contact system in the related art, and may reliably switch on or off the electrical circuit. The mechanism of the electrical contact system is very simple and has high reliability, and it may be easily manufactured and assembled. In addition, the volume of the whole electrical contact system is miniaturized, and it is beneficial to arc extinguishing.

It should be appreciated for those skilled in this art that the above embodiments are intended to be illustrative, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electrical contact system, comprising:

a pair of static contacts;

a rotatable member disposed between the pair of static contacts and rotatable about a rotation axis between a first position and a second position; and a movable contact mounted on the rotatable member and rotated with the rotatable member, a pair of opposite ends of the movable contact are in electrical contact with the pair of static contacts when the rotatable member is rotated to the first position, and the ends of the movable contact are separated from the pair of static contacts when the rotatable member is rotated to the second position, the movable contact has a Z-shape and is slidably mounted on the rotatable member, the movable contact slides under a pushing force from a first static contact of the pair static contacts toward a second static contact of the pair of static contacts to be in electrical contact with the second static contact.

2. The electrical contact system of claim 1, wherein the rotatable member has a slot, the movable contact is received in the slot and slidable in the slot in a lateral direction perpendicular to the rotation axis.

3. The electrical contact system of claim 1, wherein a first convex contact point is formed on each end of the movable contact and a second convex contact point is formed on each of the pair of static contacts.

4. The electrical contact system of claim 3, wherein the second convex contact points electrically contact the first convex contact points.

5. The electrical contact system of claim 4, further comprising a torsion spring applying a contact pressure between the first convex contact points and the second convex contact points.

6. The electrical contact system of claim 1, wherein the movable contact slides from an initial position to an offset position under the pushing force of the first static contact.

7. The electrical contact system of claim 6, wherein the movable contact remains in the offset position after the ends of the movable contact electrically contact the pair of static contacts.

8. The electrical contact system of claim 7, wherein the movable contact returns to the initial position after the ends of the movable contact are separated from the pair of static contacts.

9. The electrical contact system of claim 8, further comprising a leaf spring mounted on the rotatable member.

10. The electrical contact system of claim 9, wherein the leaf spring automatically resets the movable contact to the initial position by an elastic reset force of the leaf spring after the ends of the movable contact are separated from the pair of static contacts.

11. The electrical contact system of claim 10, wherein the movable contact has a protrusion and the leaf spring has a pair of elastic sheets, the protrusion is clamped between the pair of elastic sheets.

12. The electrical contact system of claim 2, further comprising a cap locked to an end of the rotatable member and preventing the movable contact from sliding out of the slot in an axial direction parallel to the rotation axis.

13. The electrical contact system of claim 12, wherein the cap is locked to the end of the rotatable member by an elastic latch.

14. The electrical contact system of claim 1, further comprising an insulation cover on which the pair of static contacts are fixed.

15. The electrical contact system of claim 14, further comprising a pair of screws electrically connected to a base of each of the pair of static contacts.

16. The electrical contact system of claim 15, wherein the pair of screws electrically connect the pair of static contacts to a pair of wires.

* * * * *